United States Patent [19]

Marshall

[11] Patent Number: 4,669,462

[45] Date of Patent: Jun. 2, 1987

[54] DISPOSABLE EMERGENCY RESPIRATOR

[76] Inventor: Donald K. Marshall, 2961 Industrial Rd., Ste. 66, Las Vegas, Nev. 89109

[21] Appl. No.: 577,822

[22] Filed: Feb. 7, 1984

[51] Int. Cl.[4] ..... A62B 7/00

[52] U.S. Cl. ..... 128/205.25; 128/202.13; 128/206.28; 128/206.24

[58] Field of Search ..... 128/201.15, 201.25, 128/201.29, 205.25, 206.21, 206.24, 205.13, 205.17, 205.21, 205.22, 201.22, 201.23, 202.13, 200.23, 206.12, 206.28; 132/1 R

[56] References Cited

U.S. PATENT DOCUMENTS

| | | | |
|---|---|---|---|
| 396,161 | 1/1889 | Hurd | 128/201.23 |
| 1,078,364 | 11/1913 | Longeway | 128/206.28 |
| 1,271,012 | 7/1918 | Blanc | 128/206.28 |
| 2,891,541 | 6/1959 | Tietze | 128/201.15 |
| 3,488,772 | 1/1970 | Sturm | 132/1 R |
| 3,695,264 | 10/1972 | Laeral | 128/206.28 |
| 3,976,063 | 8/1976 | Henneman et al. | 128/205.21 |
| 4,069,516 | 1/1978 | Watkins, Jr. | 128/206.24 |
| 4,440,163 | 4/1984 | Spergel | 128/205.21 |

FOREIGN PATENT DOCUMENTS

| | | | |
|---|---|---|---|
| 72784 | 2/1944 | Czechoslovakia | 128/202.13 |
| 2216025 | 10/1973 | Fed. Rep. of Germany | 128/200.23 |
| 1460623 | 10/1966 | France | 128/200.23 |
| 2481122 | 10/1981 | France | 128/206.24 |

*Primary Examiner*—Henry J. Recla

*Attorney, Agent, or Firm*—William F. Frank

[57] ABSTRACT

The present invention comprises an elongated truncated cone-like thermoplastic tube which terminates at its base end in a ring that could be fitted over face of the wearer and held there by elastic bands, the lower end of the cone or trunk like tube terminating in a flexible ring which fits over an aerosol type container filled with compressed breathable gas.

5 Claims, 5 Drawing Figures

DISPOSABLE EMERGENCY RESPIRATOR

FIELD OF INVENTION

The present invention is in the general field of respiratory devices. More particularly, the present invention relates to disposable respiratory devices which may be used for emergency purposes such as escaping from burning buildings, in case of fire on the interior of an aircraft and the like.

BACKGROUND OF THE INVENTION

The most probable cause of fatalities resulting from fire in a building particularly is due to affixiation from the inhaling of the toxic smoke of the fire. Most buildings currently being constructed have sprinkler systems on all floors which of course are activated by the heat of the fire. However, many fires originate on the lower floors, and the upper floors and stairwells become filled with smoke from the fires burning below. In all modern buildings, be they office type or hotel type, occupants are instructed not to use elevators in the event of a fire because most elevators are controlled by heat sensitive switches. Occupants are directed to use stairwells which can easily become smoke filled chimneys for the fires on the lower floors. Fire safety instructions direct occupants of a building that if the fire is on the occupants' floor, all doors to the hallways should be shut and the spaces under the doors stuffed with preferably wet cloths, and if there are ventilators over the doors, they should be somehow covered with any material that is available. The occupants are to get on the floor if possible and await rescue through the windows of the building. On the other hand if the fire is not on the occupants' floor, the occupants are directed to go to the nearest stairwell and to descend from the building through that stairwell.

In either instance described above, there has been no known provision made to date to provide occupants of particularly high-rise buildings with any sort of respiratory device which would be of assistance to them while awaiting rescue from their room or in attempting to walk down a stairwell. There is a concept of holding a cloth over ones nose and mouth while descending a stairwell but this does not provide a source of air which is free from toxic smoke nor does it protect it the eyes from contact with the toxic smoke. Large size respiratory devices such as are worn by fire fighters and scuba divers are obviously impractical and unnecessary inasmuch as they have too much weight, too expensive and are cumbersome to wear. What is needed are small emergency respiratory devices which can provide a supply of smoke free air for a limited period of time, perhaps 15 minutes to 30 minutes or perhaps less. There are small respiratory devices available such as those disclosed in U.S. Pat. Nos. 3,238,940; 3,316,907; 3,565,068 and 4,078,561. From these prior art devices only the device disclosed in U.S. Pat. No. 3,565,068 provides protection for the whole face by means of the plastic hood. However, it relies on a closed circuit rebreathing system which makes the device uncomfortable for the wearer, increases the cost of such a device to the point where it might become prohibitive as a disposable device on a large scale. The other three prior art patents similarly provide for a cover for the nose and mouth and a supply of oxygen from a container attached to the nose and mouth mask.

SUMMARY OF THE PRESENT INVENTION

The present invention comprises an elongated truncated cone-like thermoplastic tube which terminates at its base end in a ring that could be fitted over face of the wearer and held there by elastic bands, the lower end of the cone or trunk like tube terminating in a flexible ring which fits over an aerosol type container filled with compressed breathable gas.

BRIEF DESCRIPTION OF THE DRAWINGS

The present invention can be seen in a preferred embodiment in the attached drawings which are by the way illustration only.

DETAILED DESCRIPTION OF THE DRAWINGS

Figure 1:
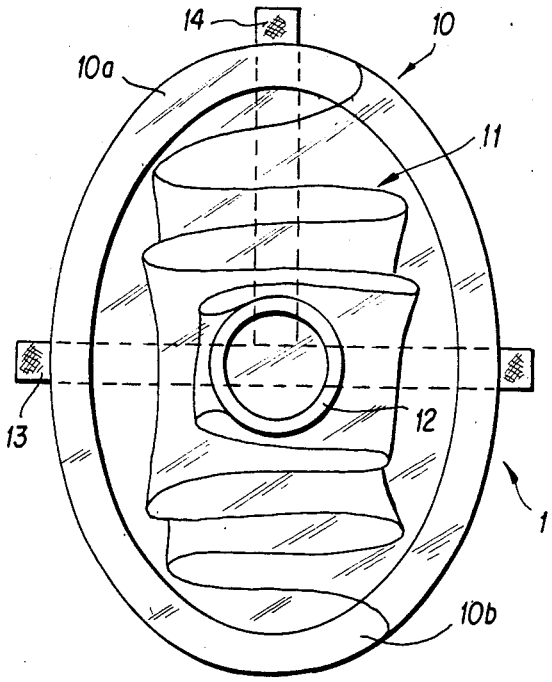
FIG. 1 is a plan view of the present invention in its packaged form.
Figure 3:
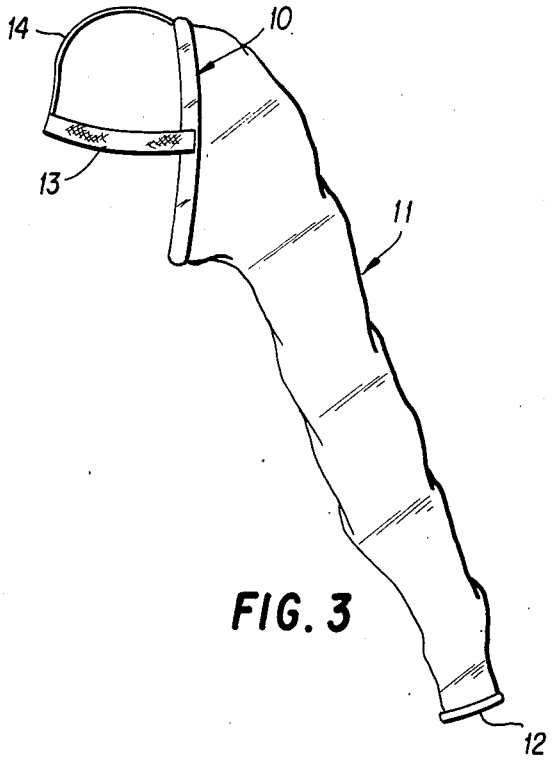
FIG. 3 shows the present invention when it is opened up and ready to be put on by the wearer.
Figure 2:
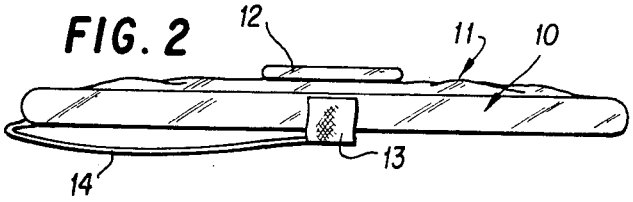
FIG. 2 is a left-side view of the invention shown in FIG. 1.
Figure 4:
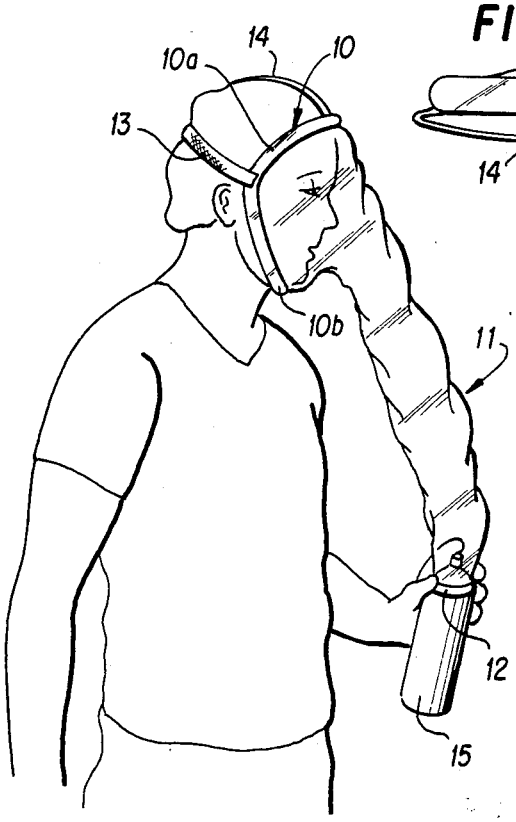
FIG. 4 is an illustration of the present invention in place on the wearer and in operating condition.

In FIGS. 1–3, the present invention is identified generally by the reference numeral 1. The invention comprises a generally oval resilient thermoplastic foam ring 10 generally of circular cross section. Attached thereto is a generally elongated cone-like transparent, pliable and foldable thermoplastic tube or trunk 11 which terminates in a circular ring 12 of the same composition as the ring 10. As seen in FIGS. 3 & 4, the tube or trunk 11, when unfolded, extends to approximately the waistline of the wearer. Attached to the back side of the ring 10 is a first head strap 13 to be passed around the back of the head and a second head strap 14 to be passed from the ring 10 over the top of the head into juncture with strap 13.

Referring now to FIG. 4, it will be seen that the present invention has been placed about the head of the wearer. A portion 10*a* of the ring 10 is placed above the brow of the wearer and the portion 10*b* is placed below the chin with straps 13 and 14 placed about the head. This will hold the ring sufficiently tightly around the face of the wearer to prevent the entrance of any smoke or other toxic gas. The tube or trunk 11 is unfolded and extended its full length to about the waistline of the wearer. The ring 12 has been placed around the top of a container of compressed air 15 which has conventional aerosol dispensing type valve which can be intermittingly depressed. It is within the scope of the invention to have a valve which is of the trickle type thus providing a constant supply of compressed air from the can. It is pointed out in this connection that the use of compressed air is preferred to oxygen first of all because it is much easier to provide a source of compressed air than to provide oxygen which requires proper supply house. Secondly, oxygen is more flammable and in its pure form is probably not desirable to be breathed for a period of time of 15 or 30 minutes without some source of nitrogen and moisture which is found in compressed air. A model of the present invention discloses that the air exhausted by the wearer's lungs can escape from the mask around the periphery of ring 10 while at the same time preventing the entrance of any toxic gas. The interior of the elongated cone 11 is coated with a glycerin-based substance such as used in connection with ski goggles or any other type of glass when there must be a reasonable sealing of the eye covering against the entrance of outside air and yet not permit the formation of fog on the inner surface that in effect blinds the wearer.

Figure 5:
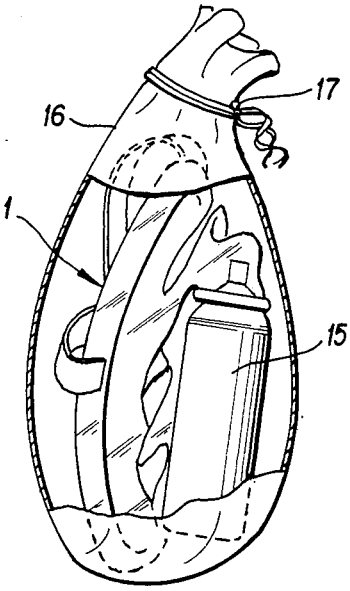
FIG. 5 is package containing the present invention a supply of compressed air as it would be stored awaiting use.

FIG. 5 shows one concept of packaging the present invention comprising a plastic bag 16, translucent or transparent, which is secured by an easily opened tie 17 or like device and contains the folded up trunk-like mask of the present invention and the container of compressed air. The plastic bag 16 should have printed on its surface indentification that it contains the respiratory device and preferably a sketch showing how the mask is to be worn, as a precautionary measure, the packets could be sterilized by irradiation techniques now in use. It will be readily apparent that the present invention is very inexpensive in cost and readily disposable after use. The present invention as a packet according to FIG. 5 could be placed in all occupied spaces of office buildings as well as hotels and in addition racks or storage boxes of the packets could be placed in stairwells. The packets could also be employed aboard aircraft wherein, with some interior fires it may be undesirable to activate the normal oxygen system because of the explosive and the inflammable qualities of oxygen.

While the present invention has been disclosed in the preferred embodiment, it will be apparent to those skilled in the art that modifications in materials and design can be made but they are considered to come within the scope of the invention as recited in the following claims.

What is claimed is:

1. A disposable mask for an emergency respiratory device comprising an elongated, truncated cone-like tube of a transparent pliable and foldable thermoplastic material, a generally oval face ring of a resilient thermoplastic foam attached to the base end of said tube, first and second head straps attached to said face ring to hold said ring about the face of a wearer and a circular ring of the same composition as said face ring secured to the truncated end of said tube to frictionally engage and hold a valved container of a breathable, compressed gas; the interior surface of said tube having a coating of an anti-fogging substance, said tube being extensible from said face ring to the waistline of the wearer when said mask is worn.

2. A disposable emergency respiratory device comprising an elongated, truncated cone-like tube of a transparent pliable and foldable thermoplastic material, a generally oval face ring of a resilient thermoplastic foam attached to the base end of said tube, first and second head straps attached to said face ring to hold said ring about the face of a wearer, a circular ring of the same composition as said face ring secured to the truncated end of said tube, the interior surface of said tube having a coating of an anti-fogging substance, and a valved container of a compressed breathable gas inserted into said circular ring, said tube being extensible from said face ring to the waistline of a wearer of said mask.

3. The device according to claim 2 wherein said gas is compressed air.

4. The device according to claim 3 wherein said gas is oxygen.

5. A disposable, emergency breathing packet comprising a translucent or transparent thermoplastic bag closed with an easily opened tie-like device, a disposable mask within said bag in the form of an elongated, truncated cone like folded up tube of a transparent pliable thermoplastic material, a generally oval face ring of a resilient thermoplastic foam attached to the base end of said tube, first and second head straps attached to said face ring to hold said ring about the face of a wearer, a circular ring of the same composition as said face ring secured to the truncated end of said tube, the interior surface of said tube having a coating of an anti-fogging substance, and a valved container of a compressed breathable gas inserted into said circular ring.

* * * * *